US006274026B1

(12) United States Patent
Schucker et al.

(10) Patent No.: US 6,274,026 B1
(45) Date of Patent: Aug. 14, 2001

(54) ELECTROCHEMICAL OXIDATION OF SULFUR COMPOUNDS IN NAPHTHA USING IONIC LIQUIDS

(75) Inventors: Robert Charles Schucker, Woodlands, TX (US); William Chalmers Baird, Jr., Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/540,728

(22) Filed: Mar. 31, 2000

Related U.S. Application Data

(60) Provisional application No. 60/138,686, filed on Jun. 11, 1999.

(51) Int. Cl.[7] ..... C10G 31/00
(52) U.S. Cl. ..... 205/696; 204/559
(58) Field of Search ..... 205/696; 204/559

(56) References Cited

U.S. PATENT DOCUMENTS

| | | | |
|---|---|---|---|
| 4,246,081 | 1/1981 | Winnick | 204/130 |
| 4,659,629 | 4/1987 | Gartner et al. | 428/469 |

FOREIGN PATENT DOCUMENTS 1272770 5/1972 (GB) .

OTHER PUBLICATIONS

Roncali, J.; "Conjugated Poly(thiophenes): Synthesis, Functionalization, and Applications", Chem Rev., 92, 711–738, 1992.

Wei, Y., Chan C., Tian J., Jang G, and Hsueh, K. F., "Electrochemical Polymerization of Thiophenes in the Presence of Bithiophene or Terthiophene: Kinetics and Mechanisms of Polymerization", Chem. Mater., 3, 888–897, 1991.

Clark, P.V.; Crowell D. O., "Fused Salt Mixtures: Eutectic Compositions and Melting Points", Sandia Laboratories Technical Library, Report No. SC–R–68–1680, TID–4500 (52nd Ed.), UC–4, Chemistry, Bibliography 1907–1968, Dec. 30, 1968.

Newman, D. S.; Kurt, E. M.; Chen, D.; "The Desulfurization of Coal and Model Coal Compounds in Ambient Temperature Molten Salts", Prepr. Pap. –Am. CHem. Soc., Div.Fuel Chem. 33(3), 113–19, 1988.

Janiszewska, L; Osteryoung, R. A.; "Electrochemistry of Polythiophene and Polybithiophene Films in Ambient Temperature Molten Salts", J. Electrochem. Soc., 134(11), 2787–94, 1987.

*Primary Examiner*—Arun S. Phasge
(74) *Attorney, Agent, or Firm*—Estelle C. Bakun

(57) ABSTRACT

The instant invention is directed to an electrochemical process for removing sulfur from a stream comprising hydrocarbon and polymerizable sulfur compounds comprising:

(a) combining a hydrocarbon feed containing polymerizable sulfur compounds with a ionic liquid;

(b) electrochemically oxidizing said combination of step (a) in an electrochemical reactor, under conditions capable of producing sulfur oligomers from said polymerizable sulfur compounds to obtain a first fraction comprising sulfur oligomers, ionic liquid, and entrained hydrocarbon, and a second fraction comprising desulfurized hydrocarbon feed;

(c) recovering said first fraction and said second fraction.

14 Claims, 1 Drawing Sheet

FIGURE
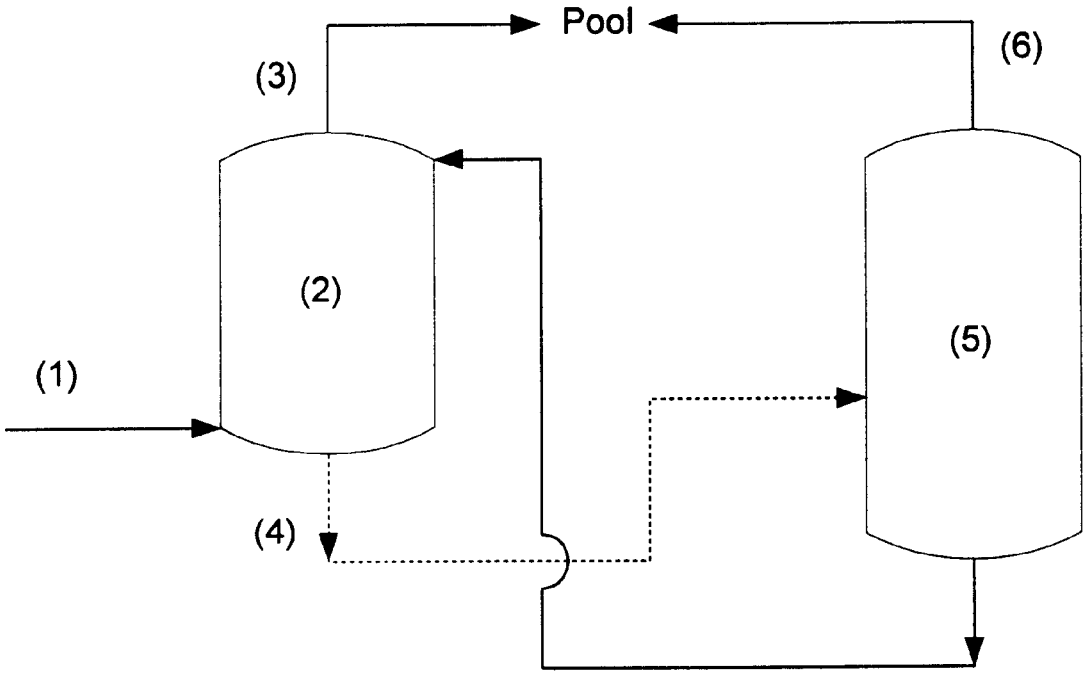

ELECTROCHEMICAL OXIDATION OF SULFUR COMPOUNDS IN NAPHTHA USING IONIC LIQUIDS

This application claims the benefit of U.S. Provisional Application No. 60/138,686 Jun. 11, 1999.

FIELD OF THE INVENTION

An embodiment of the instant invention is directed to an electrochemical process that removes sulfur from a naphtha feed stream while preserving octane number.

BACKGROUND OF THE INVENTION

Due to environmental regulations the amount of sulfur present in gasoline streams must be closely controlled. Gasoline is typically made up of a mixture of (1) naphthas from fluid catalytic cracking processes, (2) reformate from catalytic reforming processes, (3) alkylate from acid-catalyzed alkylation processes and (4) various additives. Almost all of the sulfur in gasoline is contributed by the naphtha component. The regulations will require the amount of sulfur in gasoline to be reduced to about 150 ppm by the year 2000, with further reduction to about 30 ppm by the year 2004. Thus, there is a critical need for technologies that are capable of lowering the amount of sulfur present in naphtha streams.

Present technology for lowering the amount of sulfur in naphtha streams, which is based on catalytic hydrotreating, results in an octane loss due to saturation of olefins present in the naphthas. Thus, following the sulfur removal, octane must be replaced. In the Mobil Oct-Gain and Intevep ISAL processes, for instance, the desulfurized product is isomerized, resulting in an increase in octane but at a substantial yield loss.

SUMMARY OF THE INVENTION

An embodiment of the instant invention is directed to an electrochemical process for removing sulfur from a stream comprising hydrocarbon and polymerizable sulfur compounds comprising:

(a) combining a hydrocarbon feed containing polymerizable sulfur compounds with an ionic liquid;

(b) electrochemically oxidizing said combination of step (a) in an electrochemical reactor, under conditions capable of producing sulfur oligomers from said polymerizable sulfur compounds to obtain a first fraction comprising sulfur oligomers, ionic liquid, and entrained hydrocarbon, and a second fraction comprising desulfurized hydrocarbon;

(c) recovering said first fraction and said second fraction.

BRIEF DESCRIPTION OF THE FIGURE

The FIGURE depicts one possible configuration for carrying out the instant invention. Stream (1) is a feed comprising hydrocarbon and sulfur compounds which is fed to an electrochemical reactor (2) containing an ionic liquid. The electrochemical reaction results in a desulfurized hydrocarbon (3) which is recovered from the top of the reactor and a second fraction (4) comprising ionic liquid, sulfur oligomers and any entrained hydrocarbon, which is recovered from the bottom of the reactor. The second fraction (4) may optionally be sent to a distillation column (5) where entrained desulfurized hydrocarbon (6) is recovered from the top of the distillation column and may be combined with the desulfurized hydrocarbon recovered from the electrochemical reactor. The remaining mixture comprising sulfur oligomers and ionic liquid (7) may then be recovered and recycled to the electrochemical reactor (2) for further use.

DETAILED DESCRIPTION OF THE INVENTION

The instant invention may further comprise step (d) distilling said recovered first fraction to remove and recover said entrained hydrocarbon therefrom.

The invention may likewise comprise step (e) recycling said recovered first fraction to said electrochemical reactor of step (b) prior to or following said step (d).

As used herein, an ionic liquid is defined as a liquid that is made up entirely of ions. This differentiates them from ionic solutions which are made up of ionizable materials (electrolytes) dissolved in a solvent and which contain both ionic and molecular species.

The instant invention describes a process for oxidatively coupling the polymerizable sulfur compounds contained in hydrocarbon streams such as naphtha streams. By oxidatively coupling the polymerizable sulfur compounds, thereby producing sulfur oligomers, the boiling point of the coupled compounds is increased. Typically, the polymerizable sulfur compounds are thiophenes, alkylthiophenes, benzothiophenes, alkylbenzothiophenes, and mixtures thereof.

Most of the non-mercaptan sulfur contained in naphthas is in the form of thiophenes and benzothiophenes. The lowest boiling is thiophene (84° C.). Bithiophene, a dimer of thiophene boils at 265° C. Applicants believe that in the presence of an ionic liquid, the electrochemical oxidation forms dimers and larger oligomers from thiophenes, allowing the desired hydrocarbons to be easily separated out, for example, by gravity separation, leaving the oligomers behind. Furthermore, any hydrocarbon which is entrained in the ionic liquid may also be separated by, e.g., distillation due to the increase in boiling point of the sulfur oligomers which fall outside of the naphtha boiling range. As an added benefit, the majority of nitrogen compounds should likewise be lowered through the formation of aniline oligomers.

Thus, the instant invention affords an economical safe, way to remove polymerizable sulfur compounds from hydrocarbon streams such as naphtha streams.

The ionic liquids utilized in the instant invention are any salts, or mixtures thereof not adversely affected by the voltage range being utilized in the electrochemical reactor. Typically, salts formed from organic cations and inorganic anions and that are in a liquid state at the conditions of operation will be utilized. Non-limiting examples of ionic liquids that can be utilized in the instant invention are 1-butyl-3-methylimidazolium hexafluorophosphate, 1-ethyl-3-methylimidazolium tetrachloroaluminate, 1-butylpyridinium nitrate, 1-butyl-3-methylimidazolium tetrafluoroborate and mixtures thereof. Suitable ionic liquids are easily selected by the skilled artisan. All that is necessary is that the ionic liquid be easily separated from any entrained hydrocarbon by a process such as distillation and that the ionic liquid be stable at the operating potentials utilized.

The oxidation conducted in the electrochemical reactor is conducted at potentials of 1.0–2.5 V vs Ag/AgCl reference electrode, and current densities of 1–10 mA/cm$^2$. The skilled artisan can easily perform routine experiments by cyclic voltammetry to determine the correct operating parameters to be used.

Temperatures for the electrochemical reaction range from about 0° C. to about 200° C., preferably about 0–150° C., and most preferably about 0° C. to about 100° C. Typically the temperature will be at or below about 100° C. At such temperatures, pressures will remain at about <100 psig.

Additionally, such temperatures are beneficial since naphthas, which are treated for sulfur removal, are lower boiling materials. Thus, ionic liquids melting between −50° C. and 100° C. would be particularly desirable. Such ionic liquids can be easily identified by reference to an ionic liquids review found on the world wide website for the Queen's University of Belfast (http://www.ch.qub.ac.uk), Hussey, C. L., Adv. Molten Salt Chem., 1983, 5, 185; Hussey, C. L., Pure and Appl. Chem., 1988, 60, 1763; and Wilkes, J. S. and Zaworotko, M. J., J. Chem. Soc., Chem. Comm., 1992, 965. Preferably, the reaction will be run at temperatures about 50° C. or more above the melting point of the ionic liquid being utilized.

The electrochemical reaction will be conducted at a flow rate and for a time sufficient to allow the sulfur compounds being removed to polymerize.

Such times and flow rates are readily determinable by the skilled artisan. For example, a suitable cell productivity may be defined as the feed flow ratio in barrels per hour to the area of the cell in $m^2$ (BBL/hr/$m^2$) and would typically be in the range of about 0.01–10 BBL/hr/$m^2$, preferably about 0.05 to about 5.0 and most preferably about 0.1 to about 5.0 BBL/hr/$m^2$.

The reactors which can be utilized in the instant invention are any electrochemical reactors which are capable of oxidizing sulfur compounds. For example FM21 reactors commercially available from ICI can be utilized.

The type of electrodes which can be utilized in the electrochemical reactors are easily selected by the skilled artisan.

Suitable, non-limiting examples of electrodes include platinum, stainless steel or graphite for the cathode and platinum, stainless steel, nickel, or graphite for the anode.

One further advantage of the instant invention is that as the sulfur oligomers recycled back to be combined with the hydrocarbon feed undergo further oxidation, they increase in size. This allows them to be plated out of the mixture in the electrochemical reactor onto the anode. Thus, the sulfur oligomers can easily be removed along with the anode which can easily be replaced and disposed of creating a batch process.

Thus in the instant invention an ionic liquid is utilized as a conducting medium in an electrochemical reactor to enable the ready oxidation of sulfur compounds contained in a hydrocarbon feedstream. The sulfur compounds are dimerized, trimerized, etc., to form oligomers which either plate out onto the anode, or remain in the ionic liquid. While most of the desulfurized hydrocarbon can be separated from the remaining components in the electrochemical reactor by methods such as gravity separation, some of the hydrocarbon may become entrained with the remaining components in the electrochemical reactor. The entrained hydrocarbon is easily separated by means such as distillation. Following distillation of the entrained hydrocarbon, which has had the sulfur compounds removed therefrom, the ionic liquid and oxidized sulfur compounds may be recycled back to the electrochemical reactor. Alternatively, the ionic liquid and oxidized sulfur compounds may be separated by methods such as filtration and only the ionic liquid recycled to the electrochemical reactor.

In either case, the ionic liquid and sulfur oligomers formed tend to accumulate at the bottom of the electrochemical reactor, whereas, the hydrocarbon feed, rises to the top of the reactor as a desulfurized feed. Thus, by simply using a countercurrent flow and introducing the hydrocarbon feed to be desulfurized to the bottom of a reactor containing ionic liquid, separation of desulfurized hydrocarbon from the top of the reactor post electrochemical oxidation, is readily accomplished. Thus, the instant invention affords a fast, economical way for desulfurizing hydrocarbon feeds without altering the octane number of the original hydrocarbon containing sulfur feeds. As used herein, desulfurized hydrocarbon feed is the hydrocarbon feed which contained sulfur compounds once separated from the formed sulfur oligomers.

The hydrocarbon streams which can be treated to remove sulfur compounds in accordance with the instant invention are any hydrocarbon containing sulfur compounds which undergo polymerization when oxidized. Preferably streams boiling below 500° F. will be desulfurized.

Particularly, naphtha streams will be desulfurized utilizing the instant process. Most particularly, intermediate naphtha streams will be desulfurized in accordance with the instant invention.

What is claimed is:

1. An electrochemical process for removing sulfur from a stream comprising hydrocarbon and polymerizable sulfur compounds comprising:

(a) combining a hydrocarbon feed containing polymerizable sulfur compounds with a ionic liquid;

(b) electrochemically oxidizing said combination of step (a) in an electrochemical reactor, under conditions capable of producing sulfur oligomers from said polymerizable sulfur compounds to obtain a first fraction comprising sulfur oligomers, ionic liquid, and entrained hydrocarbon, and a second fraction comprising desulfurized hydrocarbon feed;

(c) recovering said first fraction and said second fraction.

2. The process of claim 1 further comprising step (d) distilling said recovered first fraction to remove and recover said entrained hydrocarbon therefrom.

3. The process of claim 2 further comprising step (e) combining said recovered entrained hydrocarbon with said second fraction.

4. The process of claim 2 wherein following said distillation step (d) said oxidized sulfur compounds are separated from said ionic liquid.

5. The process of claim 1 wherein said recovered first fraction of said step (d) is recycled to said step (a).

6. The process of claim 1 wherein said ionic liquid is selected from the group of ionic liquids consisting of 1-butyl-3-methylimidazolium hexafluorophosphate, 1-ethyl-3-methylimidazolium tetrachloroaluminate, 1-butylpyridinium nitrate, 1-butyl-3-methylimidazolium tetrafluoroborate and mixtures thereof.

7. The process of claim 1 wherein said ionic liquid has a melting point of about −50° C. to about 100° C.

8. The process of claim 1 wherein said electrochemical oxidation is conducted at potentials of about 1.0 to about 2.5 V vs Ag/AgCl.

9. The process of claim 1 wherein said electrochemical reactor utilizes electrodes selected from the group consisting of platinum, stainless steel or graphite for the cathode and platinum, stainless steel, nickel, or graphite for the anode.

10. The process of claim 1 wherein said electrochemical oxidation is conducted at current densities of about 1 to about 10 mA/$cm^2$.

11. The process of claim 1 wherein said electrochemical oxidation is conducted at temperatures of about 0° C. to about 200° C.

12. The process of claim 1 wherein said electrochemical oxidation is conducted at cell productivities of about 0.01 to about 10 BBL/hr/$m^2$.

13. The process of claim 1 wherein said electrochemical oxidation is conducted at a temperature at least about 50° C. above the melting point of said ionic liquid.

14. The process of claim 1 wherein said polymerizable sulfur compounds are thiophenes, alkylthiophenes, benzothiophenes, alkylbenzothiophenes, and mixtures thereof.

* * * * *